United States Patent [19]

Heine et al.

[11] Patent Number: 4,674,566

[45] Date of Patent: Jun. 23, 1987

[54] CORROSION RESISTANT MODIFIED CU-ZN ALLOY FOR HEAT EXCHANGER TUBES

[75] Inventors: Murray A. Heine, Hamden; Ned W. Polan, Madison, both of Conn.

[73] Assignee: Olin Corporation, New Haven, Conn.

[21] Appl. No.: 701,726

[22] Filed: Feb. 14, 1985

[51] Int. Cl.[4] ..... F28F 19/06; C22C 9/04

[52] U.S. Cl. ..... 165/134.1; 165/905; 420/481

[58] Field of Search ..... 165/133, 134, 905, 134.1; 420/481, 499

[56] References Cited

U.S. PATENT DOCUMENTS

| | | | |
|---|---|---|---|
| 2,118,688 | 5/1938 | Webster | 420/481 |
| 2,123,840 | 7/1938 | Bunn | 420/481 |
| 2,229,622 | 1/1941 | Bunn | 288/14 |
| 2,334,753 | 11/1943 | Crampton et al. | 75/159 |
| 3,053,511 | 9/1962 | Godfrey | 165/133 |
| 3,627,593 | 12/1971 | Ansuini et al. | 148/32 |
| 3,640,781 | 2/1972 | Ansuini et al. | 148/12.7 |
| 3,703,367 | 11/1972 | Cocks | 75/157.5 |
| 3,713,814 | 1/1973 | Larsson | 75/156.5 |
| 4,128,418 | 12/1978 | Vitek | 75/157.5 |
| 4,171,972 | 10/1979 | Bates et al. | 75/157.5 |
| 4,362,579 | 12/1982 | Tsuji | 148/11.5 C |
| 4,366,117 | 12/1982 | Tsuji | 420/481 |
| 4,452,757 | 6/1984 | Kawauchi et al. | 420/471 |

FOREIGN PATENT DOCUMENTS

| | | | |
|---|---|---|---|
| 1287313 | 9/1969 | Fed. Rep. of Germany . | |
| 2065181 | 7/1971 | France . | |
| 56-69339 | 6/1981 | Japan . | |
| 0112431 | 9/1981 | Japan | 420/481 |
| 0198235 | 12/1982 | Japan | 420/481 |

OTHER PUBLICATIONS

"Effect of Additives on Dezincification Rate of Alpha-Brass at High Temperature in Vacuum", by Nagasaki et al., in the *Journal of the Japan Institute of Metals*, vol. 34, No. 3, on pp. 343 to 347.

Otsu et al., "Study of Corrosion of Copper Alloys in High Temperature Water and Steam, *Sumitomo Light Metal Technical Reports*, Jan. 1964, pp. 56-63 and Oct. 1964, pp. 52-58.

Otsu et al., "Corrosion Test on Condenser Tubes by Model Condenser at Meiko Power Station", *Sumitomo Light Metal Technical Reports*, Oct. 1965, pp. 17-45.

*Primary Examiner*—William R. Cline
*Assistant Examiner*—Randolph A. Smith
*Attorney, Agent, or Firm*—Barry L. Kelmachter; Howard M. Cohn; Paul Weinstein

[57] ABSTRACT

The present invention relates to a heat exchanger assembly having a plurality of heat exchange fluid passageways formed from a modified copper-zinc alloy. The copper-zinc alloy contains from about 21% to about 39% zinc, from about 1% to about 5% nickel, from about 0.02% to about 1% arsenic and the balance essentially copper. In a preferred embodiment, the copper-zinc alloy consists essentially of from about 25% to about 35% zinc, from about 2.5% to about 3.5% nickel, from about 0.03% to about 0.06% arsenic and the balance essentially copper. The heat exchanger assemblies of the present invention have particular utility as motor vehicle radiators.

14 Claims, 5 Drawing Figures

CORROSION RESISTANT MODIFIED CU-ZN ALLOY FOR HEAT EXCHANGER TUBES

The present invention relates to a heat exchanger assembly formed from a modified copper-zinc alloy containing nickel and arsenic and having excellent corrosion resistance and mechanical properties.

Copper base alloys have been extensively utilized in tubing for heat exchanger applications. For example, arsenical brass, copper alloy C2613, is the present alloy of choice in automotive heat exchangers. Arsenical brass has a nominal composition of about 30% Zn, about 0.05% As, 0.05% max Pb, 0.05% max Fe and the balance copper. Recent tests have shown that exposure to salt spray from road surfaces can cause severe corrosive attack in heat exchanger assemblies formed from arsenical brass after relatively short periods of use. These tests indicate that arsenical brass exhibits severe attack after just 100 hours of salt spray exposure.

Other alloys which have found wide acceptance due to their good balance of corrosion resistance and mechanical properties include cupronickel alloys. In particular, alloys such as Alloy C70600 and C71500, containing, respectively, 10% and 30% nickel in a copper base, are used in tubular form in heat exchanger assemblies in power generating plants. U.S. Pat. No. 3,053,511 illustrates a heat. exchanger having tubular members formed from a clad cupronickel alloy material Cupronickel alloys such as these, although widely used, do have their own difficulties. In particular, at least 10% nickel is usually necessary in the alloys to achieve good corrosion resistance. This tends to make the alloys quite expensive and economically noncompetitive with other non-copper alloy systems.

Various alloy systems utilizing varied alloy additions to provide the desired set of corrosion resistance properties have been developed to overcome the high cost of the copper-nickel alloy systems. For example, U.S. Pat. Nos. 3,627,593, 3,640,781, 3,703,367, 3,713,814 and 4,171,972 all utilize various additions of nickel to copper-zinc alloy bases to provide increased corrosion resistance along with increased strength properties. U.S. Pat. Nos. 3,627,593 and 3,640,781 utilize a basic copper-nickel-zinc alloy to provide these properties while U.S. Pat. No. 3,703,367 utilizes titanium additions together with aluminum or nickel additions or both to copper-zinc alloy bases to provide these increases in properties to the alloy systems. U.S. Pat. No. 3,713,814 utilizes a copper-zinc base to which are added various alloying elements such as lead, nickel, manganese and aluminum, among others, to provide an alloy system which exhibits good resistance against corrosion. U.S. Pat. No. 4,171,972 utilizes alloying additions of nickel, zinc, and iron in a copper base with optional additions of cobalt and manganese to provide the desired corrosion resistance and strength properties.

Various Japanese scientists have studied the effect of additives to particular copper alloy systems to determine the effect of these additives upon corrosion properties of the systems. In particular, Nagasaki et al. have indicated in their report "Effect of Additives on Dezincification Rate of Alpha-Brass at High Temperature in Vacuum" in the *Journal of Japan Institute of Metals*, Volume 34, No. 3 on pages 343 to 347 that various elements including iron, cobalt, and nickel may be added in ranges up to 1 or 2% to prevent the dezincification of copper base alloys.

Accordingly, it is an object of the present invention to provide a heat exchanger assembly having improved resistance to salt spray attack.

It is a further object of the present invention to provide a heat exchanger assembly as above formed from a copper base alloy having improved corrosion resistance.

It is a further object of the present invention to provide a heat exchanger assembly as above formed from an economically competitive copper base alloy.

These and further objects and advantages will become more apparent from the following description and drawings in whch like reference numerals depict like elements.

The heat exchanger assemblies of the present invention fulfill the foregoing objects and advantages by forming the fluid passageways or tubes from a copper base alloy system having improved corrosion resistance. The copper base alloy system provides the desired level of corrosion resistance by modifying a copper-zinc alloy with alloying additions of nickel and arsenic. In addition to providing the desired corrosion resistance properties, the copper base alloy system exhibits excellent mechanical properties such as strength and ductility. The alloy system is preferably processed in such a manner so as to maintain a single phase within the alloy structure since multiple phases within the structure have an inherently detrimental effect upon corrosion resistance performance.

In accordance with the present invention, a heat exchanger is provided having improved resistance to attack from salt containing fluids. The heat exchanger assemblies of the present invention preferably comprise a plurality of tubes, through which a suitable heat exchange fluid flows, formed from a modified copper-zinc alloy containing nickel and arsenic.

Figure 1:
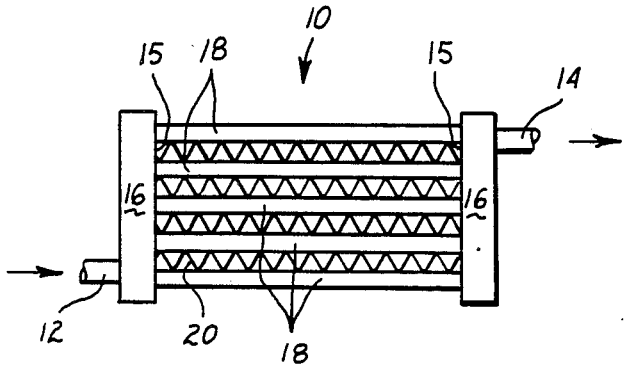
FIG. 1 illustrates a heat exchanger assembly formed in accordance with the present invention.

Referring now to FIG. 1, a typical heat exchanger assembly 10 is illustrated. The heat exchanger assembly 10 comprises a pair of tanks 16 each having a header 15, connected by a plurality of tubes or fluid passageways 18. Generally, one of the tanks 16 acts as a fluid distributor for distributing a heat exchange fluid throughout the assembly 10 and has a fluid inlet 12 through which the heat exchange fluid, such as an ethylene glycol solution, enters the assembly. The other tank 16 generally acts as a fluid collector and has a fluid outlet 14 through which the heat exchange fluid leaves the assembly 10. The tubes 18 may be joined to the headers 15 and tanks 16 in any desired manner. Typically, each tube 18 is soldered to each header 15 with a lead-tin material.

The heat exchanger assembly further comprises a plurality of cooling fins 20 attached to the tubes 18 for effecting heat transfer and for positioning the tubes. While the fins 20 may be joined to the tubes 16 in any desired manner, they are typically soldered to the tube with a lead-tin solder such as 90Pb-10Sn solder. Each cooling fin 20 preferably comprises a continuous strip of metal or metal alloy. While the strip material forming the cooling fin 20 may have any desired configuration, strip materials having a corrugated or serpentine configuration are generally used.

To provide the heat exchanger assembly 10 with improved resistance to corrosive attack from salt containing fluids, each tube 18 is preferably formed from a modified copper-zinc alloy system containing nickel and arsenic. This modified copper-zinc alloy system contains from about 21% to about 39% zinc, from about 1% to about 5% nickel, from about 0.02% to about 1% arsenic and the balance essentially copper. The alloy system may also contain those impurities typically associated with this type of system, however, the impurities should not be present at levels which detract from the desirable properties of the alloy system. Within this alloy system, the nickel content is important from a ductility standpoint. Since the tubes 18 are generally formed from a substantially flat metal strip, good ductility properties are desirable to facilitate the tube forming operation. It has been found that a nickel content greater than 5% requires a significantly increased annealing temperature in order to maintain required ductility. The arsenic content in the alloy system is significant in one respect from the standpoint of substantially preventing dealloying. However, it is more significant in that neither arsenic alone nor nickel alone provide the improvement in performance obtained with the nickel plus arsenic combination. In a preferred embodiment of the present invention, the copper-zinc alloy consists essentially of from about 25% to about 35% zinc, from about 2.5% to about 3.5% nickel, from about 0.03% to about 0.06% arsenic and the balance essentially copper. It should be noted that the foregoing percentages are weight percentages.

The processing of this alloy system follows conventional practice. The alloy system undergoes both hot and cold working to an initial reduction gauge, followed by annealing and cold working in cycles down to the final desired gauge. It is desirable to process the alloy so it retains its single phase throughout all steps of the processing.

The alloy may be cast in any desired manner such as Durville, direct chill or continuous casting. The alloy may be poured at a temperature of about 1100° C. to about 1300° C., although it is preferred to pour the alloy at a temperature in the range of about 1200° C. to about 1250° C. The cast ingot is preheated for hot working at a temperature in the range of about 800° C. to about 900° C. for about 2 hours. The preheated ingot is then hot worked such as by hot rolling to about 0.30 to about 0.50 inch gauge.

The alloy is then cold worked such as by cold rolling to a desired gauge with or without intermediate annealing depending upon the particular gauge requirements in the final strip material. In general, annealing may be performed using either strip or batch processing with holding times of from about 10 seconds to about 24 hours at temperatures ranging from about 200° C. to about 500° C., preferably for about 1 minute to about 1 hour at a temperature from about 325° C. to about 475° C. If desired, the material may be cleaned after annealing. Any suitable cleaning technique such as immersing the material in an aqueous sulfuric acid solution may be used. After the alloy has been processed to the desired gauge, the metal strip may be formed into the tubes 18 using any conventional tube forming operation known in the art.

The heat exchanger assembly 10 may be formed using any conventional manufacturing process known in the art. Typically, heat exchangers are fabricated by first forming the tubes 18 and either soldering the tube seams using conventional lead-tin solders such as 90Pb-10Sn solder or welding them such as by induction welding. After the tubes 18 have been formed, a cooling fin 20 is joined to each tube. While the cooling fin 20 may be formed from the same material as the tube 18, generally it is formed from a different metal or metal alloy. For example, each cooling fin 20 may be formed from a copper base alloy such as copper alloy C11000. The fins 20 are typically soldered to the tubes 18 with 90Pb-10Sn solder. Following this, the headers 15 and tanks 16 are joined to the tube-fin assemblies. Here again, while the headers 15 and tanks 16 may be formed from the same material as the tubes, they are generally formed from a different metal or metal alloy. Copper base alloys such as 70Cu-30Zn brass are typically used to form the headers and tanks. During fabrication of the tanks, or immediately thereafter, a tube forming the fluid inlet/outlet 12 or 14 is joined to each tank 16. The headers 15 and tanks 16 may be joined to the tube-fin sub-assemblies using any suitable brazing or solder material known in the art. Typically, Pb-Sn solders are used to bond the tubes and the header-tank assemblies together. After the headers, tanks, tubes and fins have been assembled, reinforcements not shown may be attached at the edges if desired. These reinforcements may be formed from any suitable metal or metal alloy. When assembled, the headers, tanks, tubes, fins and reinforcements, if any, comprise the radiator core. If desired, the radiator core may be encased in a metal or metal alloy tank not shown. Here again, 70Cu-30Zn brass is a material of choice for the tank.

While the heat exchanger assemblies of the present invention have particular utility as or as part of a motor vehicle radiator, they could be used in other applications where resistance to attack from corrosive salt containing fluids is important.

The heat exchanger assemblies of the present invention and the advantages provided thereby may be more readily understood from a consideration of the following illustrative example.

EXAMPLE

A series of copper base alloys containing zinc, arsenic and nickel additions were cast as ten pound Durville ingots. For comparison purposes, a series of copper-zinc-nickel alloys without arsenic were also cast as Durville ingots. The copper was melted first and the alloy addition sequence was Ni, Zn, and As. The pouring temperature was about 1175° C. After casting, the ingots were preheated for hot rolling at 825° C. for 2 hours. The ingots were hot rolled from 1.7 to 0.50 inch gauge. The hot rolled plates were reheated for 15 minutes at 825° C. and air cooled to homogenize the hot rolled microstructure. The plate was milled to produce a clean unoxidized surface then cold rolled to 0.010" gauge, using interanneals at 350° C. for 1 hour followed by sulfuric acid cleaning for 30 seconds at 70% cold rolling intervals. In addition to the cast alloys, commercially available arsenical brass, copper alloy C2613, strip material was processed to 0.010" gauge. The nominal compositions of the cast alloys and the arsenical brass are shown in Table I. The compositions are given in weight percentages.

TABLE I

| Alloy | % Zn | % Ni | % As | % Cu |
|---|---|---|---|---|
| A | 31.09 | 1.02 | 0 | bal. |
| B | 31.07 | 3.02 | 0 | bal. |
| C | 31.00 | 5.11 | 0 | bal. |
| D | 30.36 | 0.85 | 0.043 | bal. |
| E | 30.89 | 2.47 | 0.036 | bal. |
| F | 30.72 | 4.68 | 0.040 | bal. |
| G | 30.01 | 7.03 | 0 | bal. |
| H | 29.94 | 6.95 | 0.030 | bal. |
| I | 30.07 | 10.02 | 0 | bal. |
| J | 30.02 | 9.84 | 0.042 | bal. |
| C2613 | 31.61 | 0 | 0.038 | bal. |

To simulate a radiator core, six coupons of each alloy were fluxed in a water soluble bromide flux and then dip soldered in a 90Pb-10Sn solder bath at 370° C. After being water washed, the coupons and corrugated fins formed from copper alloy C11000 were fluxed in another water soluble bromide flux. A fin was attached to each coupon. The fins on coupons were then placed on stainless steel plates and baked at 335° C. for 6 minutes. After baking, the coupon and fin assemblies were again water washed. The coupons and fin assemblies were then subjected to a standard salt spray test, ASTM B117, for 256 hours. After the salt spray test was completed, each coupon and fin assembly was examined for both overall pitting population and depth of attack.

Figure 2:
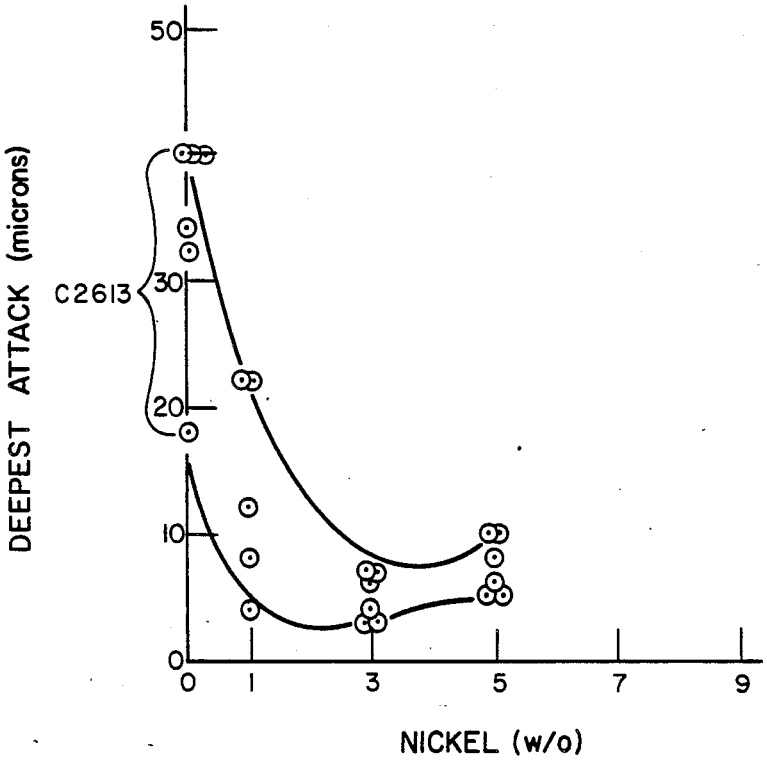
FIG. 2 is a graph illustrating the effect on the deepest attack of nickel additions to copper-zinc-arsenic alloys.
Figure 3:
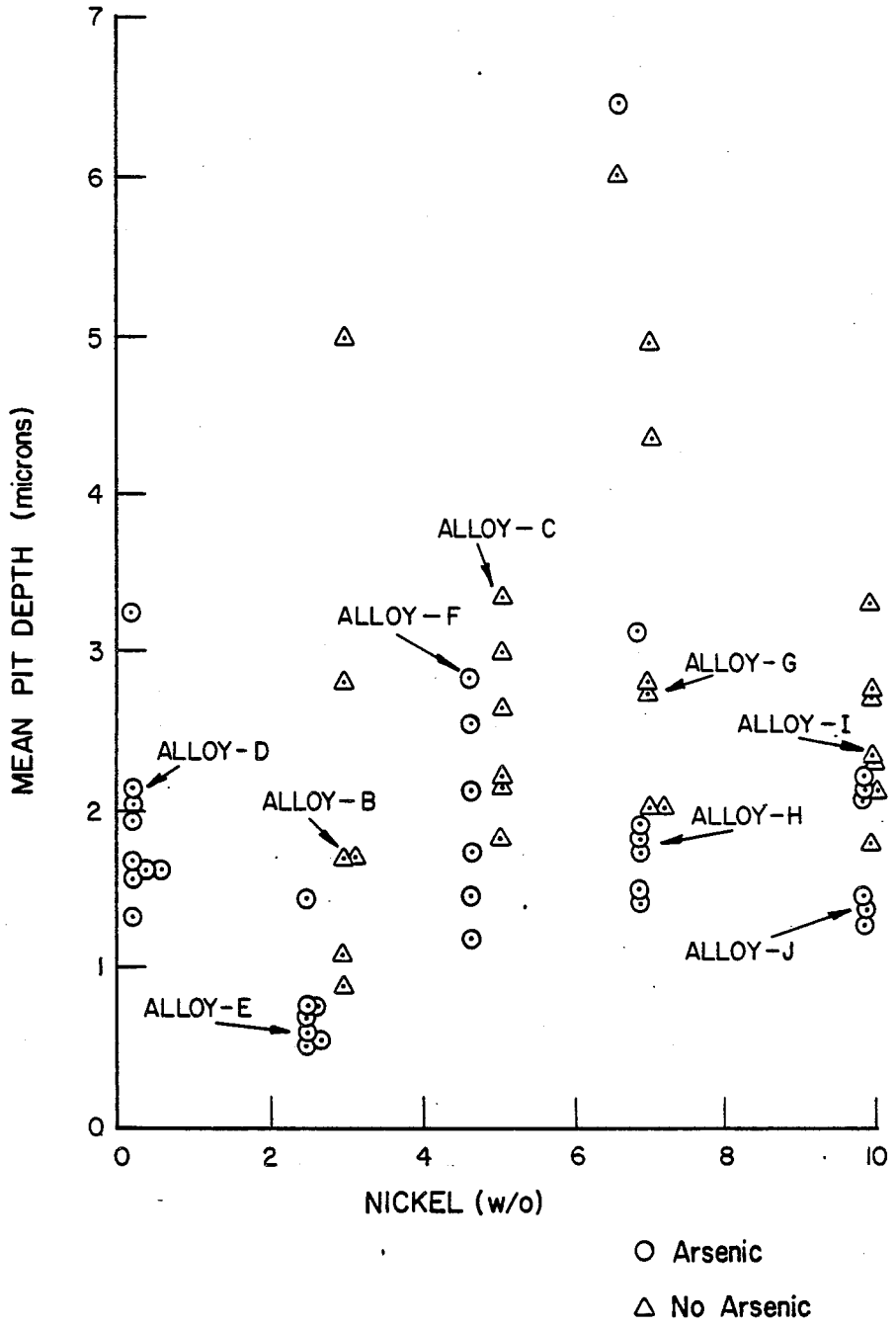
FIG. 3 is a graph illustrating the effect on mean pit depth of arsenic additions to copper-zinc-nickel alloys.
Figure 4:
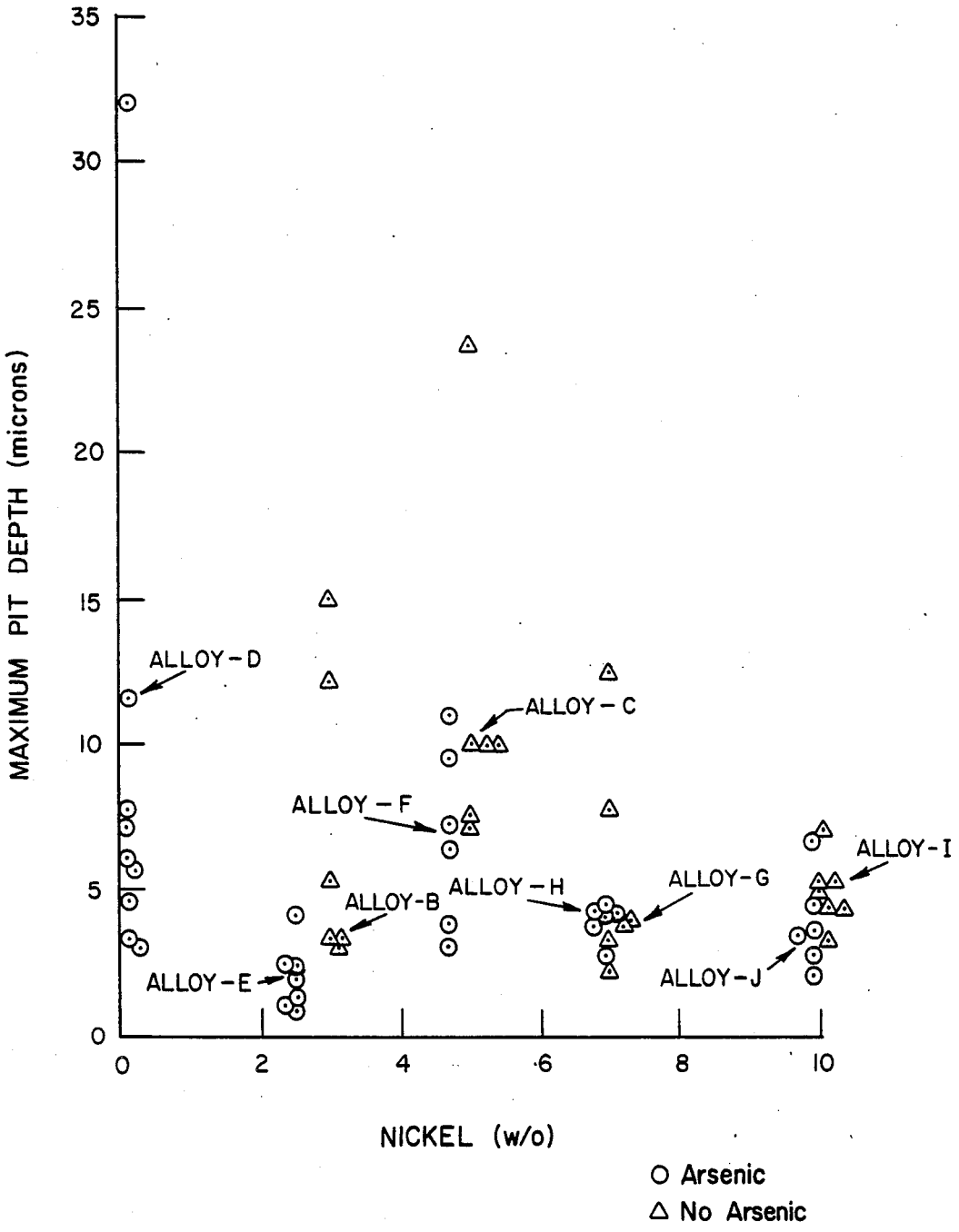
FIG. 4 is a graph illustrating the effects on maximum pit depth of arsenic additions to copper-zinc-nickel alloys.
Figure 5:
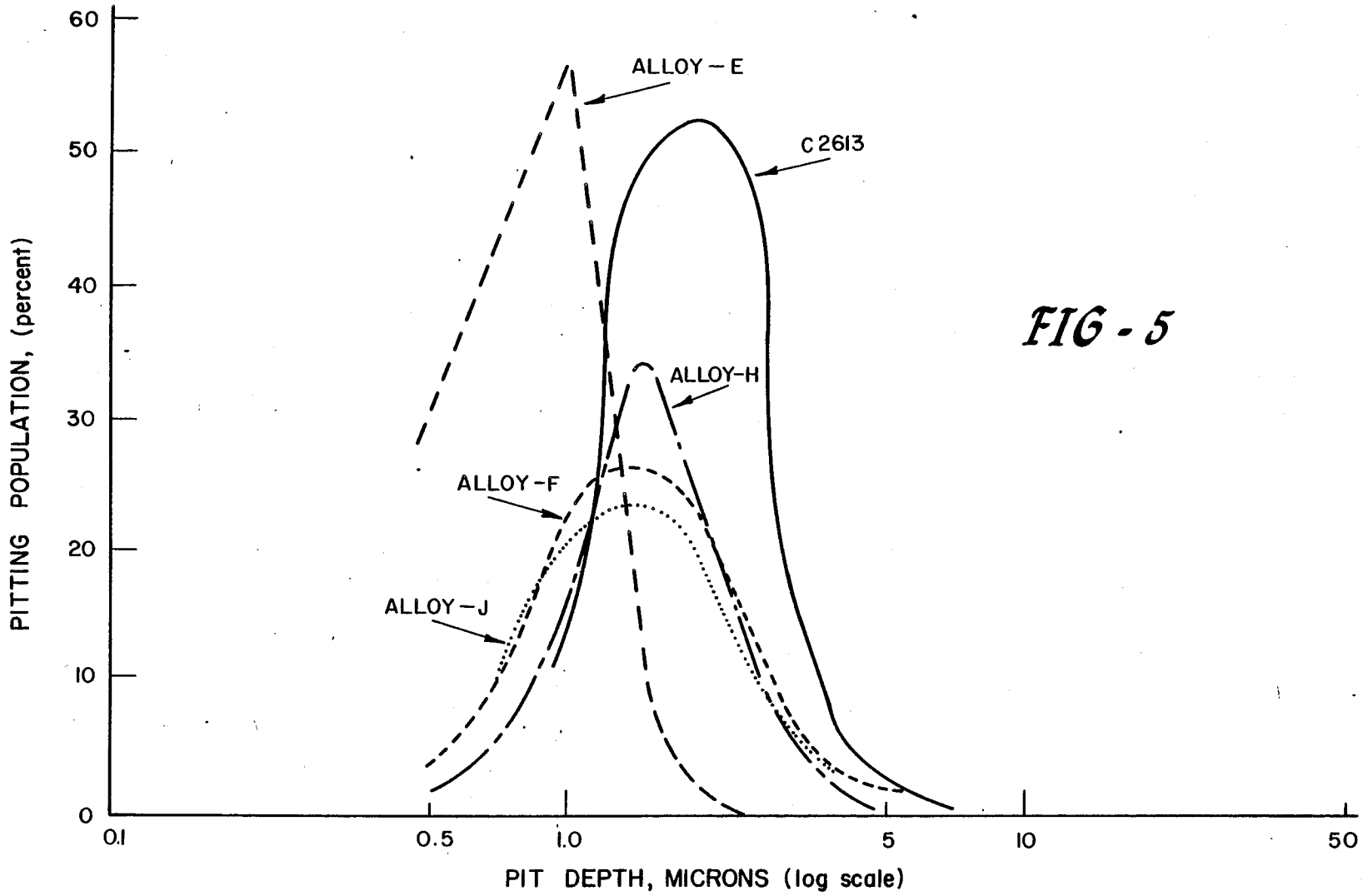
FIG. 5 is a graph illustrating the effect of nickel content on pitting population versus the log pit depth.

FIG. 2 illustrates the effect of nickel additions in the range of about 1% to about 5% to copper-zinc-arsenic brass on depth of attack. As can be seen from this figure, the best results were obtained with those alloys having a nickel content of about 3% by weight. FIGS. 3 and 4 demonstrate that for a given nickel content, the addition of arsenic generally reduces both the mean pit depth and the maximum pit depth caused by the salt spray attack. Again, those alloys having a nickel content of about 3% by weight with an arsenic addition provided the best results. FIG. 5 illustrates the percent pitting population for Cu-Zn-Ni-As alloys in the fin region of the simulated radiator sections versus log pit depth. This figure clearly demonstrates the benefits to be obtained by using a nickel addition in the range of about 2.5% to about 3.5% in combination with an arsenic addition.

The foregoing example amply demonstrates that neither an arsenic addition alone nor a nickel addition alone to a copper-zinc alloy provide the improvement in performance obtained with the combined nickel plus arsenic additions. Furthermore, the foregoing example illustrates the benefits to be obtained by using the Cu-Zn-Ni-As alloy system of the present invention in those environments exposed to salt containing fluids.

While the tubes 18 generally have an oval or rectangular cross sectional shape, they may be provided with any desired cross sectional shape. The patents set forth in the specification are intended to be incorporated by reference herein.

It is apparent that there has been provided in accordance with this invention a corrosion resistant modified Cu-Zn alloy for heat exchanger tubes which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A heat exchanger having improved resistance to corrosive attack from a salt containing fluid, said heat exchanger comprising:

a plurality of fluid passageways;

each said passageway being formed from a copper base alloy consisting essentially of from about 1.0% to about 5.0% by weight nickel, from about 21.0% to about 39.0% by weight zinc, from about 0.02% to about 1.0% by weight arsenic and the balance essentially copper; and said copper base alloy providing said improved resistance to corrosive attack from said salt containing fluid.

2. The heat exchanger of claim 1 further comprising at least one heat transfer surface bonded to said passageways.

3. The heat exchanger of claim 1 further comprising at least one tank and header assembly joined to said fluid passageways.

4. The heat exchanger of claim 1 further comprising at least one fluid inlet and at least one fluid outlet.

5. The heat exchanger of claim 1 further comprising:

two spaced apart tank and header assemblies, one of said tank and header assemblies having a fluid inlet associated therewith and the other of said tank and header assemblies having a fluid outlet associated therewith; and each of said passageways being positioned between and joined to said tank and header assemblies.

6. The heat exchanger of claim 5 further comprising:

said fluid passageways comprising a plurality of tubes; and each of said tubes having a metal or metal alloy fin assembly bonded to its outer surface.

7. The heat exchanger of claim 6 further comprising:

each fin assembly having a corrugated configuration.

8. The heat exchanger of claim 6 further comprising:

said tank and header assemblies and said fin assemblies being formed from a copper base alloy.

9. The heat exchanger of claim 1 wherein each of said fluid passageways comprises a tube assembly having a soldered or welded seam.

10. The heat exchanger of claim 1 wherein said heat exchanger comprises a motor vehicle radiator.

11. The heat exchanger of claim 1 wherein said copper base alloy consists essentially of from about 2.5% to about 3.5% by weight nickel, from about 25.0% to about 35.0% by weight zinc, from about 0.03% to about 0.06% by weight arsenic and the balance copper.

12. A copper base alloy having improved resistance to attack from a salt containing fluid for use in heat exchanger applications, said alloy consisting essentially of from about 2.5% to about 5.0% by weight nickel to reducing the depth of attack caused by said salt containing fluid, from about 21.0% to about 39.0% by weight zinc, from about 0.02% to about 1.0% by weight arsenic, and the balance copper.

13. The copper base alloy of claim 12 further consisting essentially of from about 2.5% to about 3.5% by weight nickel, from about 25.0% to about 35.0% by weight zinc, from about 0.03% to about 0.06% by weight arsenic and the balance copper.

14. The copper base alloy of claim 12 wherein said arsenic and said nickel content of said alloy reduce the mean pit depth and the maximum pit depth caused by said salt containing fluid.

* * * * *